US007886705B2

(12) United States Patent
Holler et al.

(10) Patent No.: US 7,886,705 B2
(45) Date of Patent: Feb. 15, 2011

(54) ENGINE SYSTEM HAVING DEDICATED THERMAL MANAGEMENT SYSTEM

(75) Inventors: Dennis P. Holler, West Lafayette, IN (US); Scott D. Vollmer, Joliet, IL (US); Travis S. Johnson, West Lafayette, IN (US); Sudhakar R. Kakani, Lafayette, IN (US); Matthew R. Hulen, West Lafayette, IN (US); Randall J. Anliker, Francesville, IN (US); Michael W. Edwards, West Lafayette, IN (US); Larry L. Spurgeon, Rensselaer, IN (US); Victor L. Sheldon, Jr., Spring, TX (US); Robert C. Horst, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 354 days.

(21) Appl. No.: 12/068,489

(22) Filed: Feb. 7, 2008

(65) Prior Publication Data

US 2008/0295791 A1 Dec. 4, 2008

Related U.S. Application Data

(60) Provisional application No. 60/924,789, filed on May 31, 2007.

(51) Int. Cl.
*F02N 17/02* (2006.01)

(52) U.S. Cl. ..... 123/142.5 R

(58) Field of Classification Search ..... 123/142.5 R
See application file for complete search history.

(56) References Cited

U.S. PATENT DOCUMENTS

| | | | | |
|---|---|---|---|---|
| 1,651,156 | A * | 11/1927 | Rushmore | 123/196 AB |
| 2,070,092 | A * | 2/1937 | Ramsaur | 123/196 AB |
| 2,748,570 | A * | 6/1956 | Booth | 165/51 |
| 3,977,376 | A | 8/1976 | Reid et al. | |
| 4,249,491 | A | 2/1981 | Stein | |
| 4,278,062 | A * | 7/1981 | DeSilva | 123/552 |
| 4,299,198 | A * | 11/1981 | Woodhull | 126/247 |
| 4,911,110 | A | 3/1990 | Isoda et al. | |
| 5,943,991 | A | 8/1999 | Moroi et al. | |
| 6,354,266 | B1 | 3/2002 | Cornell et al. | |
| 6,928,973 | B2 | 8/2005 | Suzuki | |
| 7,159,554 | B2 * | 1/2007 | Catalano | 123/142.5 R |
| 2005/0161519 | A1 * | 7/2005 | Kalbacher et al. | 236/34.5 |
| 2005/0166881 | A1 | 8/2005 | Catalano | |
| 2006/0042583 | A1 | 3/2006 | Bourgault et al. | |

FOREIGN PATENT DOCUMENTS

DE 2850572 A * 5/1980

* cited by examiner

*Primary Examiner*—Noah Kamen
(74) *Attorney, Agent, or Firm*—Finnegan, Henderson, Farabow, Garrett & Dunner LLP

(57) ABSTRACT

A thermal management system for an engine is disclosed. The thermal management system may have a first hydraulic circuit configured to circulate a fluid through the engine. The thermal management system may also have a second hydraulic circuit pressurized by the engine to heat the fluid during operation of the engine.

20 Claims, 1 Drawing Sheet

ENGINE SYSTEM HAVING DEDICATED THERMAL MANAGEMENT SYSTEM

RELATED APPLICATIONS

This application is based on and claims the benefit of priority from U.S. Provisional Application No. 60/924,789, filed May 31, 2007, the contents of which are expressly incorporated herein by reference.

TECHNICAL FIELD

The present disclosure relates generally to an engine system and, more particularly, to an engine system having a dedicated thermal management system.

BACKGROUND

Engines, including diesel engines, gasoline engines, and gaseous fuel-powered engines are used to generate mechanical, hydraulic, or electrical power output. In order to accomplish this power generation, an engine typically combusts a fuel/air mixture. With the purpose to ensure optimum combustion of the fuel/air mixture and protect components of the engine from damaging extremes, the temperature of the engine and air drawn into the engine for combustion must be tightly controlled.

An internal combustion engine is generally fluidly connected to several different liquid-to-air and/or air-to air heat exchangers to cool both liquids and gases circulated throughout the engine. These heat exchangers are often located close together and/or close to the engine to conserve space on the machine. An engine-driven fan is disposed either in front of the engine/exchanger package to blow air across the exchangers and the engine, or between the exchangers and engine to suck air past the exchangers and blow air past the engine, the airflow removing heat from the heat exchangers and the engine.

Although this cooling arrangement may minimize the likelihood of engine overheating and improve combustion in extreme hot conditions, it may do little to protect the engine and optimize combustion during operation in extreme cold conditions. In extreme cold conditions, engines can be difficult to start and oil that lubricates components of the engine can be so viscous that significant friction within the engine is generated and damage to the engine may occur. In addition, when the air drawn into the engine is too cold, combustion of the fuel/air mixture may be poor, resulting in poor load acceptance, white smoke production, and poor fuel efficiency.

One way to improve engine operation and extend component life of the engine in cold extremes is disclosed in U.S. Pat. No. 4,249,491 (the '491 patent) issued to Stein on Feb. 10, 1981. The '491 patent describes an apparatus for maintaining an engine in readiness for use while it is otherwise non-operational. The engine has an oil lubrication circuit and a coolant circuit. When the engine is not in use, oil and coolant from the engine are diverted to and pressurized by operation of external supply pumps. From the supply pumps, the oil and coolant are directed through a heat exchanger where an electrical heating element raises the temperature thereof. The heated oil and coolant are then directed back into the engine such that the engine is maintained at a temperature in readiness for use.

Although the apparatus of the '491 patent may improve readiness of an engine by maintaining operating temperatures when the engine is non-operational, the apparatus may be costly to operate and its applicability may be limited. Specifically, it may be costly to maintain operating temperatures of an engine when the engine is non-operational, especially when the engine is non-operational for extended periods of time. And, because the apparatus relies on an externally powered electrical heating element to provide the heat and drive the supply pumps, the apparatus may only be useful when an external power supply is available. Thus, during operation of the engine away from a base service station such as in a vehicular application, auxiliary heating of the engine may be difficult, if not impossible, with the apparatus of the '491 patent.

The disclosed engine system is directed to overcoming one or more of the problems set forth above.

SUMMARY OF THE INVENTION

In one aspect, the present disclosure is directed to a thermal management system. The thermal management system may include a first hydraulic circuit configured to circulate a fluid through the engine. The thermal management system may also include a second hydraulic circuit pressurized by the engine to heat the fluid during operation of the engine.

In another aspect, the present disclosure is directed to a method of controlling the temperature of an engine. The method may include drawing power from the engine to pressurize a fluid, and directing the fluid through the engine. The method may also include drawing power from the engine to pressurize a heat transferring medium, and transferring heat from the heat transferring medium to the fluid.

DETAILED DESCRIPTION

Figure 1:
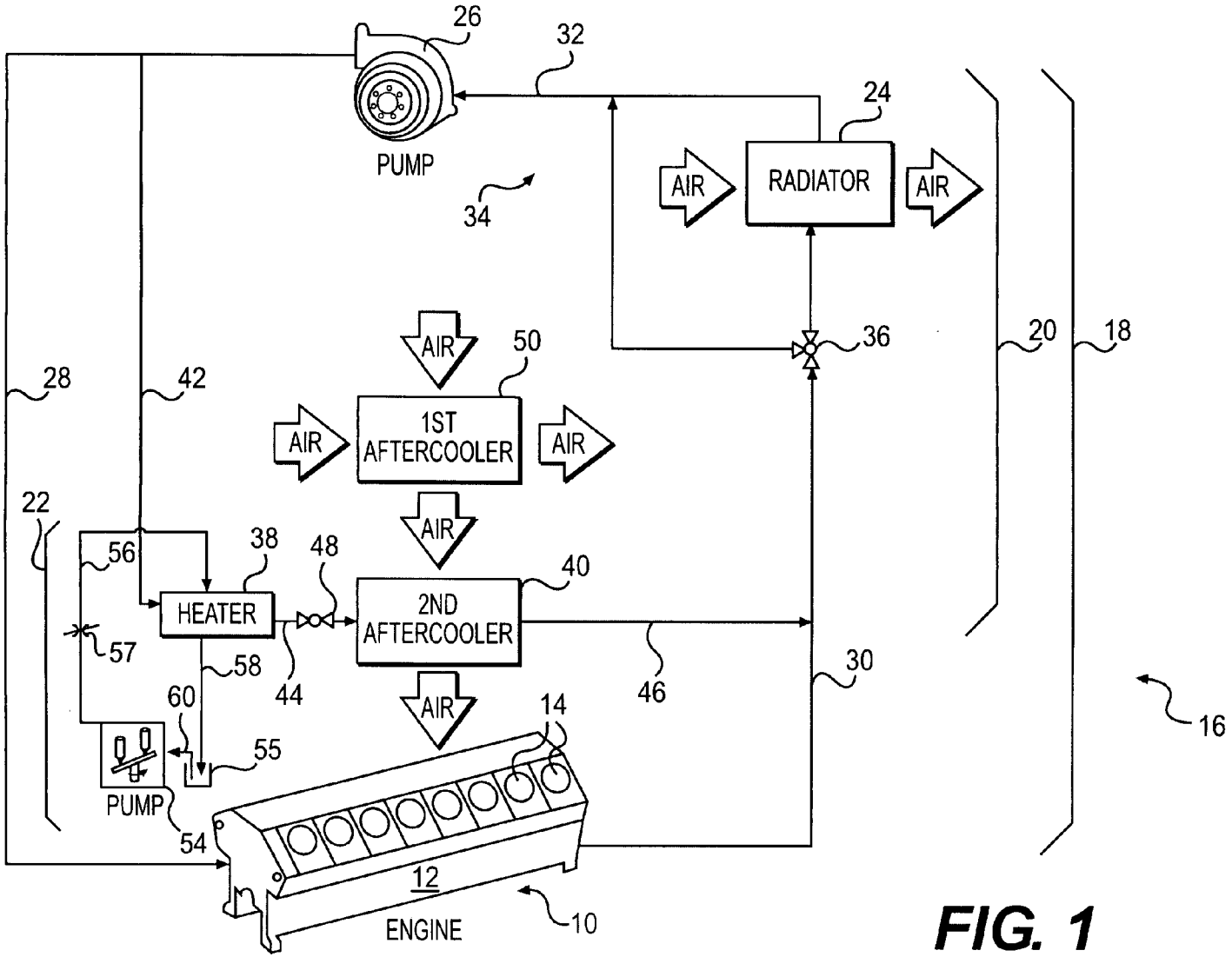
FIG. 1 is a pictorial and schematic illustration of an exemplary disclosed engine system.

FIG. 1 illustrates an exemplary disclosed engine 10 that combusts a fuel/air mixture to produce a power output. Engine 10 may include an engine block 12 that at least partially defines a plurality of cylinders 14. For the purposes of this disclosure, engine 10 is depicted and described as a four-stroke diesel engine. One skilled in the art will recognize, however, that engine 10 may be any other type of combustion engine such as, for example, a gasoline or a gaseous fuel-powered engine. In the illustrated embodiment, engine 10 includes sixteen cylinders 14 (only 8 shown). However, it is contemplated that engine 10 may include a greater or lesser number of cylinders 14, and that cylinders 14 may be disposed in an "in-line" configuration, a "V" configuration, or any other suitable configuration.

As also shown in FIG. 1, engine 10 may be associated with one or more systems that facilitate the production of power. In particular, engine 10 may include a thermal management system 16 having a first circuit 18, a second circuit 20, and a third circuit 22. Fluid flows may be regulated through any one or all of first, second, and third circuits 18-22 to control temperatures of engine 10. It is contemplated that engine 10 may be associated with additional systems such as, for example, a fuel system, a lubrication system, a braking system, an air conditioning system, an exhaust system, an emissions control system, a performance control system, and other such known systems, which may be used to facilitate the operation of engine 10.

First circuit 18 may include components that cooperate to cool engine 10. Specifically first circuit 18 may include a heat exchanger 24 and a pump 26. Coolant such as water, glycol, a water/glycol mixture, a blended air mixture, or any other heat transferring fluid may be pressurized by pump 26 and directed through a passageway 28 to engine 10 to absorb heat therefrom. After exiting engine 10, the coolant may be directed through a passageway 30 to heat exchanger 24 to release the absorbed heat, and then be drawn through a passageway 32 back to pump 26. A bypass circuit 34 having a valve 36 may selectively direct some or all of the coolant from passageway 30 around heat exchanger 24 directly to passageway 32 in response to one or more input.

Pump 26 may be engine-driven to generate the flow of coolant described above. In particular, pump 26 may include an impeller (not shown) disposed within a volute housing having an inlet and an outlet. As the coolant enters the volute housing, blades of the impeller may be rotated by operation of engine 10 to push against the coolant, thereby pressurizing the coolant. An input torque imparted by engine 10 to pump 26 may be related to a pressure of the coolant, while a speed imparted to pump 26 may be related to a flow rate of the coolant. It is contemplated that pump 26 may alternatively embody a piston type pump, if desired, and may have a variable or constant displacement.

Heat exchanger 24 may embody the main radiator (i.e., a high temperature radiator) of engine 10 and be situated to dissipate heat from the coolant after it passes through engine 10. As the main radiator of engine 10, heat exchanger 24 may be an air-to-liquid type of exchanger. That is, a flow of air may be directed through channels of heat exchanger 24 such that heat from the coolant in adjacent channels is transferred to the air. In this manner, the coolant passing through engine 10 may be cooled to below a predetermined operating temperature of engine 10.

A cooling fan (not shown) may be associated with heat exchanger 24 to generate the flow of cooling air. In particular, the fan may include an input device (not shown) such as a belt driven pulley, a hydraulically driven motor, or an electrically powered motor that is mounted to or otherwise associated with engine 10, and fan blades (not shown) fixedly or adjustably connected to the input device. The cooling fan may be powered by engine 10 to cause the input device to rotate and the connected fan blades to blow or draw air across heat exchanger 24. It is contemplated that the cooling fan may additionally blow or draw air across engine 10 for external cooling thereof, if desired.

Bypass circuit 34 may be used to regulate a temperature of the coolant passing through engine 10 and, thereby, the temperature of engine 10. Specifically, in response to a desired increase in coolant temperature (or at least a desire to prevent or minimize a decrease in coolant temperature), valve 36 may restrict or even block the connection from passageway 30 to heat exchanger 24 and, simultaneously, at least partially open the bypass connection between passageways 30 and 32. In this manner, the flow of coolant through heat exchanger 24 may be reduced or even completely blocked, thereby minimizing the amount of heat transfer from the coolant to the cooling air passing through heat exchanger 24.

Second circuit 20 may include components that facilitate heating of air drawn into engine 10. Specifically second circuit 20 may include a heater 38 located upstream of a heat exchanger 40 and downstream of pump 26. Coolant from first circuit 18 may be selectively directed through a passageway 42 to heater 38 where additional or supplemental heat (i.e., heat in addition to that already absorbed from engine 10 by the coolant within first hydraulic circuit 18) may be added to the coolant. From heater 38, the coolant may be directed by way of a passageway 44 to heat exchanger 40 and, from there, through a passageway 46 to passageway 30. I this configuration, passageways 28 and 42 may be situated to receive coolant from pump 26 in parallel, while passageways 46 and 30 may be situated to discharge the coolant to heat exchanger 24 in parallel. A valve 48 may be disposed within passageway 44 to regulate the flow of coolant between heater 38 and heat exchanger 40.

Valve 48 may be a two position or proportional type valve having a valve element movable to regulate a flow of coolant through passageway 44. Specifically, the element of valve 48 may be movable from a first position, at which fluid is allowed to flow through passageway 44 substantially unrestricted by valve 48, toward a second position, at which fluid is blocked from flowing through passageway 44. The element of valve 48 may be movable to any position between the first and second positions to vary a restriction of the coolant flow and, thereby, a flow rate of the coolant. Valve 48 may be actuated in response to one or more input.

Heater 38 may warm the coolant passing through second circuit 20. Heater 38 may embody any type of heater known in the art such as, for example, a liquid-to-liquid heat exchanger that receives heated fluid from third circuit 22 to raise the temperature of the coolant passing through heat exchanger 40 (and, subsequently, the intake air entering engine 10) to a desired level.

Heat exchanger 40 may embody an after cooler of engine 10 and be situated to add heat to the intake air as it enters engine 10. Similar to heat exchanger 24, heat exchanger 40 may also be an air-to-liquid type of exchanger. That is, a flow of air may be directed through channels of heat exchanger 40 such that heat from the coolant in adjacent channels (i.e., the coolant already heated by heater 38) is transferred to the intake air before the air enters engine 10. In this manner, the air entering engine 10 may be heated above a predetermined operating temperature of engine 10.

Third circuit 22 may include components that facilitate the heating of coolant passing through heater 38. Specifically third circuit 22 may include a pump 54 configured to draw fluid from a tank 55, pressurize the fluid, and pass the pressurized fluid through a valve 57 to heater 38. The fluid may be pressurized by pump 54 and directed through a passageway 56 to heater 38 to reject heat to the coolant of second circuit 20. After exiting first heater 38, the fluid may be directed through a passageway 58 to a tank 55, and then be drawn from tank 55 through a passageway 60 back to pump 54.

Pump 54 may be engine-driven to generate the flow of fluid within third circuit 22. In contrast to pump 26, pump 54 may be a piston type pump. Specifically, pump 26 may include a plurality of pistons held against a tiltable and rotatable swash plate. Each of the pistons may be slidingly disposed within an associated bore and driven to reciprocate therein by the rotation of the swashplate. A joint such as, for example, a ball and socket joint, may be disposed between each piston and the swashplate to allow for relative movement therebetween. When the swashplate is driven by engine 10 to rotate, the reciprocating pistons may draw fluid into their respective bores and then force the fluid from the bores at a predetermined pressure. During operation, the swashplate may be tilted to any angle to vary the displacement of the pistons within the bores and, thereby, vary the flow rate and/or pressure of the fluid discharged from the bores. It is contemplated that pump 54 may alternatively have a fixed displacement or be replaced with a non-piston type of pump, if desired.

Tank 55 may constitute a reservoir configured to hold a supply of fluid. The fluid may include, for example, a dedicated hydraulic oil, an engine lubrication oil, a transmission lubrication oil, a coolant, or any other fluid known in the art. One or more hydraulic systems associated with engine 10 may draw fluid from and return fluid to tank 55. It is contemplated that third circuit 22 may be connected to multiple separate fluid tanks or to a single tank.

Valve 57 may be located within passageway 56 and between pump 54 and heater 38 to control a restriction of passageway 56. Valve 57 may include a valve element movable from a flow-passing position toward a flow-restricting position. The valve element may be selectively moved to any position between the flow passing position and the flow-restricting position to vary the restriction of passageway 56. As the restriction within passageway 56 increases, an amount of energy imparted by pump 54 to the fluid in the way of heat increases. Similarly, as the pressurized fluid flows through valve 57, the restriction at valve 57 may convert fluid energy (i.e., pressure and/or flow velocity) to heat. The heat generated as a result of the restriction at valve 57 may be transferred to the coolant of second circuit 20 by way of heater 38. Thus, a greater amount of restriction at valve 57 may be directly related to an amount of heat transfer at heater 38.

An additional heat exchanger 50 may be situated in series with heat exchanger 40 of first circuit 18 (either upstream or downstream) to remove heat from the intake air as it enters engine 10. In contrast to heat exchanger 40, heat exchanger 50 may be an air-to-air type of exchanger. That is, the flow of intake air may be directed through channels of heat exchanger 50 such that heat from the intake air is transferred to a flow of cooling air in adjacent channels before the intake air enters engine 10. In this manner, the air entering engine 10 may be cooled to below a predetermined operating temperature of engine 10.

The intake air passing through heat exchangers 40 and 50 may be charged. That is, engine 10 may include a charged air induction system (not shown) having at least one air compressor (not shown). The compressor may be exhaust driven by way of a turbine (i.e., the compressor and turbine, together, may form a turbocharger), or mechanically or electrically driven by engine 10 (i.e., the compressor may be one component of a supercharger). In either situation, the compressor may be located upstream of heat exchangers 40 and 50 to either compress air and force the compressed air through heat exchangers 40 and 50 into engine 10, or located downstream of heat exchangers 40 to draw the air through heat exchangers 40 and 50 and force the cooled or heated air into engine 10.

It is contemplated that only one of heat exchangers 40 and 50 may be functional at a given time. That is, if it is desired to heat the intake air flowing into engine 10, valve 48 may be open and heater 38 actuated to heat coolant within second circuit 20 such that the air passing through heat exchanger 40 is heated to the desired temperature. In this situation, the flow of cooling air passing through heat exchanger 50 may be minimized or even blocked completely (i.e., the air passing through heat exchanger 50 is substantially unaffected by heat exchanger 50). However, if it is desired to cool the air flowing into engine 10, valve 48 may be closed, heater 38 deactivated, and cooling air may be directed through heat exchanger 50 so that the intake air passing through first heat exchanger 50 is cooled, while heat exchanger 40 has no substantial affect on the intake air.

Bypass circuit 34 may be used to increase the maximum temperature to which second circuit 20 may elevate the intake air of engine 10. Specifically, in the event of air heating (i.e., when heater 38 is actuated and the element of valve 48 is moved to the flow passing position), the element of valve 36 may move to cause coolant to bypass heat exchanger 24. In this manner, little, if any, temperature reduction of the coolant within first and second circuits 18, 20 may be affected by heat exchanger 24.

INDUSTRIAL APPLICABILITY

The disclosed cooling system may be used in any machine or power system application where it is beneficial to both heat and cool the air utilized for combustion. In particular, the disclosed cooling system may provide cooled and heated air in different situations such that optimal engine performance is realized. The disclosed system may provide this temperature flexibility by incorporating an air-heating circuit with a parasitic engine-driven heater and an air cooling circuit. The operation of thermal management system 16 will now be described.

During operation of engine 10, the various operational fluids thereof may be undesirably heated or cooled beyond acceptable operational ranges. For example, engine coolant may be circulated through and absorb heat from engine block 12, the external walls of cylinders 14, and/or cylinder heads associated with each cylinder 14 for cooling purposes. Air pressurized by the turbine- or engine-driven compressor may rise in temperature as a result of the pressurization and, when mixed with fuel and combusted, may heat up even more. If unaccounted for, these high temperatures could reduce the effectiveness or even result in failure of their respective systems. In contrast, when operating in extremely cold conditions, the coolant, oil, and/or air may be too cold for efficient or proper operation.

In order to maintain proper operating temperatures of the various engine systems, the fluids of each system may be directed through heat exchangers for heat transfer purposes. For example, the intake air upstream or downstream of the compressor may be directed through heat exchanger 50 and then heat exchanger 40 before entering engine 10. As the intake air flows through heat exchanger 50, a flow of coolant air may absorb heat from the intake air. As the intake air flows through heat exchanger 40, coolant from second circuit 20 may impart heat to the intake air.

To cool the intake air entering engine 10, valve 48 may be closed and heater 38 may be deactivated such that heat exchanger 50 cools the air. To heat the air, valve 48 may be opened and the flow of cooling air through heat exchanger 50 blocked (or at least partially restricted) such that the heat absorbed by the coolant passing through engine 10 may be returned to engine 10 by way of the intake air. Additionally, the elements of valve 36 may be moved to bypass coolant around heat exchanger 24 such that little, if any, heat absorbed by the coolant is dissipated to the atmosphere by way of heat exchanger 24.

In moderate conditions, it may be desirable to target specific temperature ranges that result in optimal operation of engine 10. In these conditions, valves 36, 48, and 57, and/or the operation of heater 38 may be selectively manipulated to warm or cool the air such that a desired temperature within the specific temperature range is achieved.

Because the disclosed thermal management system may both heat and cool the intake air, as necessary, operation of engine 10 may be optimized. And, because the disclosed thermal management system may include a provision for supplemental heat (i.e., heater 38), the intake air may be heated even when the coolant passing through engine 10 is cold. This provision may facilitate cold start operations and optimal operation even in extremely cold conditions.

By heating engine 10 only when engine 10 is operational, the cost of operating and maintaining engine 10 may be minimal. That is, few resources, if any, may be unnecessarily used to heat engine 10 when engine 10 is non-operational for extended periods of time. Yet, because engine 10 can be heated by way of parasitic losses (i.e., by way of third circuit 22, which may be driven by engine 10), engine 10 can always benefit from the heating, even when away from a base service station.

It will be apparent to those skilled in the art that various modifications and variations can be made to the disclosed thermal management system without departing from the scope of the disclosure. Other embodiments of the thermal management system will be apparent to those skilled in the art from consideration of the specification and practice of the thermal management system disclosed herein. It is intended that the specification and examples be considered as exemplary only, with a true scope of the disclosure being indicated by the following claims and their equivalents.

What is claimed is:

1. A thermal management system for an engine, comprising:
- a first closed-loop hydraulic circuit configured to circulate a fluid through the engine;
- a second closed-loop hydraulic circuit pressurized by the engine to transfer heat to the fluid during operation of the engine;
- a pump driven by the engine to pressurize a heat transferring medium in the second hydraulic circuit and circulate the heat transferring medium through the second hydraulic circuit; and
- a heat exchanger configured to facilitate the transfer of heat from the heat transferring medium of the second hydraulic circuit to the fluid of the first hydraulic circuit.

2. The thermal management system of claim 1, wherein the second closed loop hydraulic circuit is dedicated to only heating the fluid.

3. The thermal management system of claim 1, wherein the pump is a piston type pump.

4. The thermal management system of claim 1, further including a restrictive element configured to restrict a flow of the heat transferring medium.

5. The thermal management system of claim 4, wherein the restrictive element has a variable restriction.

6. The thermal management system of claim 1, wherein the first hydraulic circuit includes:
- a first flow path through the engine; and
- a second flow path in parallel with the first flow path and through the heat exchanger.

7. The thermal management system of claim 6, wherein at least some fluid always flows through the first flow path.

8. The thermal management system of claim 1, further including:
- a radiator configured to cool the fluid; and
- a bypass circuit associated with the radiator, wherein the bypass circuit is open to direct the fluid around the radiator when the second closed-loop hydraulic circuit is heating the fluid of the first closed-loop hydraulic circuit.

9. The thermal management system of claim 1, further including a valve configured to selectively allow fluid from the first closed-loop hydraulic circuit to pass through the heat exchanger.

10. A thermal management system for an engine, comprising:
- a first hydraulic circuit configured to circulate a fluid through the engine; and
- a second hydraulic circuit pressurized by the engine to transfer heat to the fluid during operation of the engine and including:
  - a pump driven by the engine to pressurize a heat transferring medium;
  - a heat exchanger configured to facilitate the transfer of heat from the heat transferring medium of the second hydraulic circuit to the fluid of the first hydraulic circuit; and
  - a restrictive element having a variable restriction and being configured to restrict a flow of the heat transferring medium, wherein a restriction of the restrictive element is varied based on a temperature of the fluid in the first hydraulic circuit; and
- an aftercooler connected to the first hydraulic circuit to receive the fluid and transfer heat from the fluid to intake air of the engine.

11. A method of controlling the temperature of an engine, comprising:
- drawing power from the engine to pressurize a fluid;
- directing the fluid through a closed-loop circuit that includes the engine;
- drawing power from the engine to pressurize a heat transferring medium;
- transferring heat from the heat transferring medium to the fluid; and
- restricting a flow of the heat transferring medium,
- wherein the flow of the heat transferring medium is restricted an amount based on a temperature of the fluid.

12. A method of controlling the temperature of an engine, comprising:
- drawing power from the engine to pressurize a fluid;
- directing the fluid through the engine;
- drawing power from the engine to pump a heat transferring medium and thereby heat and circulate the heat transferring medium;
- transferring heat from the heat transferring medium to the fluid; and
- directing at least a portion of the fluid through an aftercooler to transfer heat from the fluid to intake air entering the engine.

13. The method of claim 12, wherein the heat transferring medium is only used to heat the fluid.

14. The method of claim 12, further including restricting a flow of the heat transferring medium.

15. A power system, comprising:
- an engine having a cylinder block;
- an engine cooling circuit including:
  - a first pump driven by the engine to pressurize a coolant and direct the coolant through the cylinder block; and
  - a radiator configured to condition the coolant;
- a heater circuit including a second pump driven by the engine to pressurize oil;
- a heat exchanger configured to facilitate the transfer of heat from the oil to the coolant; and
- a throttling valve configured to restrict a flow of the oil in an amount based on a temperature of the coolant.

16. The power system of claim 15, wherein the heater circuit is dedicated to only heating the oil.

17. The power system of claim 15, wherein the second pump is a piston type pump.

18. The power system of claim 15, wherein the engine cooling circuit includes:
- a first flow path through the cylinder block; and
- a second flow path in parallel with the first flow path and through the heat exchanger.

19. The power system of claim 18, wherein at least some fluid always flows through the first flow path.

20. The power system of claim 15, further including a valve configured to selectively allow coolant from the engine cooling circuit to pass through the heat exchanger.

* * * * *